US011719505B2

(12) United States Patent
Trpkovski et al.

(10) Patent No.: US 11,719,505 B2
(45) Date of Patent: Aug. 8, 2023

(54) MODULAR STOCK FOR A WEAPON

(71) Applicant: Ravin Crossbows, LLC, Superior, WI (US)

(72) Inventors: Paul Trpkovski, Kailua Kona, HI (US); Dayne Lester, Sunriver, OR (US); Joshua Hanzel, Kailua Kona, HI (US)

(73) Assignee: RAVIN CROSSBOWS, LLC, Superior, WI (US)

( * ) Notice: Subject to any disclaimer, the term of this patent is extended or adjusted under 35 U.S.C. 154(b) by 23 days.

(21) Appl. No.: 17/571,315

(22) Filed: Jan. 7, 2022

(65) Prior Publication Data

US 2022/0214132 A1 Jul. 7, 2022

Related U.S. Application Data

(60) Provisional application No. 63/136,573, filed on Jan. 12, 2021, provisional application No. 63/134,957, filed on Jan. 7, 2021.

(51) Int. Cl.
*F41B 5/12* (2006.01)
*F41B 5/06* (2006.01)

(52) U.S. Cl.
CPC ..... *F41B 5/123* (2013.01); *F41B 5/066* (2013.01); *F41B 5/12* (2013.01)

(58) Field of Classification Search
CPC ..... F41B 5/12; F41B 5/123; F41B 5/0026; F41B 5/0031
See application file for complete search history.

(56) References Cited

U.S. PATENT DOCUMENTS

| | | | | |
|---|---|---|---|---|
| 5,522,373 | A * | 6/1996 | Barnett | F41B 5/12 124/25 |
| 9,121,659 | B1 * | 9/2015 | Chang | F41B 5/123 |
| 9,568,269 | B1 * | 2/2017 | Chang | F41B 5/126 |
| 9,689,639 | B1 * | 6/2017 | Liu | F16B 21/06 |
| 10,139,190 | B1 * | 11/2018 | Trpkovski | F41B 5/123 |
| 10,520,273 | B2 * | 12/2019 | Bednar | F41B 5/123 |
| 10,930,553 | B2 * | 2/2021 | Clevenger | H01L 23/528 |
| 10,969,191 | B2 * | 4/2021 | Wong | F41B 5/14 |
| 11,268,792 | B2 * | 3/2022 | O'Reilly | B65B 5/08 |
| 2014/0283805 | A1 * | 9/2014 | Dunlop | F41B 5/1469 124/25 |
| 2016/0290757 | A1 | 10/2016 | Khoshnood | |
| 2017/0115090 | A1 | 4/2017 | Bofill | |

FOREIGN PATENT DOCUMENTS

WO WO-2013/122951 A1 8/2013

OTHER PUBLICATIONS

International Search Report and Written Opinion issued in PCT/US2022/011678, dated Nov. 14, 2022.

* cited by examiner

*Primary Examiner* — John A Ricci
(74) *Attorney, Agent, or Firm* — Foley & Lardner LLP

(57) ABSTRACT

A stock includes a first end that has a stock mounting interface that is configured to mate with a like interface of a weapon. The first end has a quiver mounting feature configured to attach to a quiver. The stock includes a second end that has a quiver pocket defined therein to at least partially receive a portion of a quiver therein. The quiver pocket has at least one quiver grip positioned therein.

20 Claims, 14 Drawing Sheets

MODULAR STOCK FOR A WEAPON

CROSS-REFERENCE TO RELATED APPLICATIONS

This application claims priority to U.S. Application No. 63/136,573, filed on Jan. 12, 2021, titled MODULAR STOCK FOR A WEAPON, and to U.S. Application No. 63/134,957, filed on Jan. 7, 2021, titled MODULAR STOCK FOR A WEAPON, the disclosures of which are hereby incorporated by reference in their entireties.

BACKGROUND

Projectile launchers, such as crossbows and slingshots, utilize a string that is drawn backward and released to fire a projectile. Flexible limbs are loaded with force by the drawstring being drawn, and limbs are unloaded with force when the crossbow is fired to aggressively power the movement of the drawstring toward the front of the crossbow.

Overall size of not just the projectile launcher, but a weapon in general, is important for both accuracy and maneuverability. Typically, if a user can shoulder a weapon with the use of a stock, the more stable a user can make the weapon, which leads to improved accuracy. However, the longer the weapon, the more cumbersome it is to maneuver. Therefore, improvements are desired.

SUMMARY

This application generally relates to a modular stock for a weapon. In one example, a stock is disclosed that includes a toolless interface (also referred to as a "tool free" interface) for attaching to a projectile launcher and a removable arrow quiver.

In one aspect of the present disclosure, a stock for a weapon is disclosed. The stock includes a body having a first end and a second end. The first end having a mounting interface and a quiver mounting feature. The mounting interface is at least one of a projection or a recess and the mounting interface is configured to mate with a like mounting interface using an interference fit. The body also includes the second end that has a quiver pocket that is configured to at least partially receive a portion of a quiver therein. The quiver pocket has at least one quiver grip positioned therein. The stock includes a quiver that is configured to store a plurality of projectiles. The quiver has a stock mounting feature that is at least one of a projection or a recess. The quiver is configured to be positioned within the quiver pocket at the second end and attached to the first end at the quiver mounting feature via the stock mounting feature.

In another aspect of the present disclosure, a weapon system is disclosed. The weapon system includes a weapon that is configured to propel a projectile from a front end. The weapon has a rear interface at a rear end, and the rear interface has at least two stock mating elements. The weapon includes a stock configured to be positioned against a shoulder of a user. The stock has a stock mounting interface configured to mate with the rear interface of the weapon. The stock mounting interface has at least two weapon mating elements. At least one weapon mating element of the stock and at least one stock mating element of the weapon mate together using an interference fit to secure the stock to the weapon.

In another aspect of the present disclosure, a stock for a weapon is disclosed. The stock includes a body having a first end and a second end, the second end opposite the first end. The first end that has a stock mounting interface that is configured to mate with a like interface of a weapon. The first end has a quiver mounting feature configured to attach to a quiver. The second end has a quiver pocket defined therein to at least partially receive a portion of a quiver therein. The quiver pocket has at least one quiver grip positioned therein.

Another aspect is a removable stock for a weapon, the stock comprising: a body having a stock interface configured to removably couple the stock to a rear interface of the weapon, the stock interface including at least a first and a second mating element, wherein the first mating element is a pivotal connection element which, when connected with the rear interface of the weapon, permits the stock to pivot with respect to the weapon about the pivotal connection element, and wherein the second mating element is an interference fit element that releasably engages the rear interface of the weapon with an interference fit such that, when the second mating element is engaged with the rear interface of the weapon, the stock is prevented from pivoting about the pivotal connection element, and when the second mating element is disengaged from the rear interface of the weapon, the stock is free to pivot about the pivotal connection element.

Yet another aspect is a removable stock for a weapon comprising a body including a stock interface for removably connecting the stock with a rear interface of the weapon, wherein the stock interface comprises one or more mating elements that provide a snap-fit connection with the rear interface of the weapon.

A further aspect is a removable stock for a weapon, the stock comprising: a body having a stock interface configured to removably couple the stock to a rear interface of the weapon, the stock interface including at least a first and a second mating element, wherein the first mating element is connectable to the rear interface of the weapon, and wherein the second mating element is an interference fit element that releasably engages the rear interface of the weapon with an interference fit such that, when the second mating element is engaged with the rear interface of the weapon, the stock is prevented from moving at the first mating element, and when the second mating element is disengaged from the rear interface of the weapon, the stock can move at the first mating element.

Another aspect is a projectile launcher comprising: a rear interface configured to mate with a stock interface of a removable stock, the rear interface including at least a first and a second mating element, wherein the first mating element is a pivotal connection element which, when connected with the stock interface of the removable stock, permits the stock to pivot with respect to the projectile launcher about the pivotal connection element, and wherein the second mating element is an interference fit element that releasably engages the stock interface of the removable stock with an interference fit such that, when the second mating element is engaged with the stock interface of the removable stock, the stock is prevented from pivoting about the pivotal connection element, and when the second mating element is disengaged from the stock interface of the removable stock, the stock is free to pivot about the pivotal connection element.

A further aspect is a rear interface of a projectile launcher, the rear interface being configured to mate with a stock interface of a removable stock, the rear interface comprising one or more mating elements that provide a snap-fit connection with the stock interface of the removable stock.

Yet another aspect is a projectile launcher comprising: a rear interface configured to mate with a stock interface of a removable stock, the rear interface including at least a first and a second mating element, wherein the first mating element is connectable to the stock interface of the removable stock, and wherein the second mating element is an interference fit element that releasably engages the stock interface of the removable stock with an interference fit such that, when the second mating element is engaged with the stock interface of the removable stock, the stock is prevented from moving at the first mating element, and when the second mating element is disengaged from the stock interface of the removable stock, the stock can move at the first mating element.

A variety of additional aspects will be set forth in the description that follows. The aspects can relate to individual features and to combinations of features. It is to be understood that both the foregoing general description and the following detailed description are exemplary and explanatory only and are not restrictive of the broad inventive concepts upon which the embodiments disclosed herein are based.

BRIEF DESCRIPTION OF THE DRAWINGS

The following drawings are illustrative of particular embodiments of the present disclosure and therefore do not limit the scope of the present disclosure. The drawings are not to scale and are intended for use in conjunction with the explanations in the following detailed description. Embodiments of the present disclosure will hereinafter be described in conjunction with the appended drawings, wherein like numerals denote like elements.

DETAILED DESCRIPTION

Figure 1:
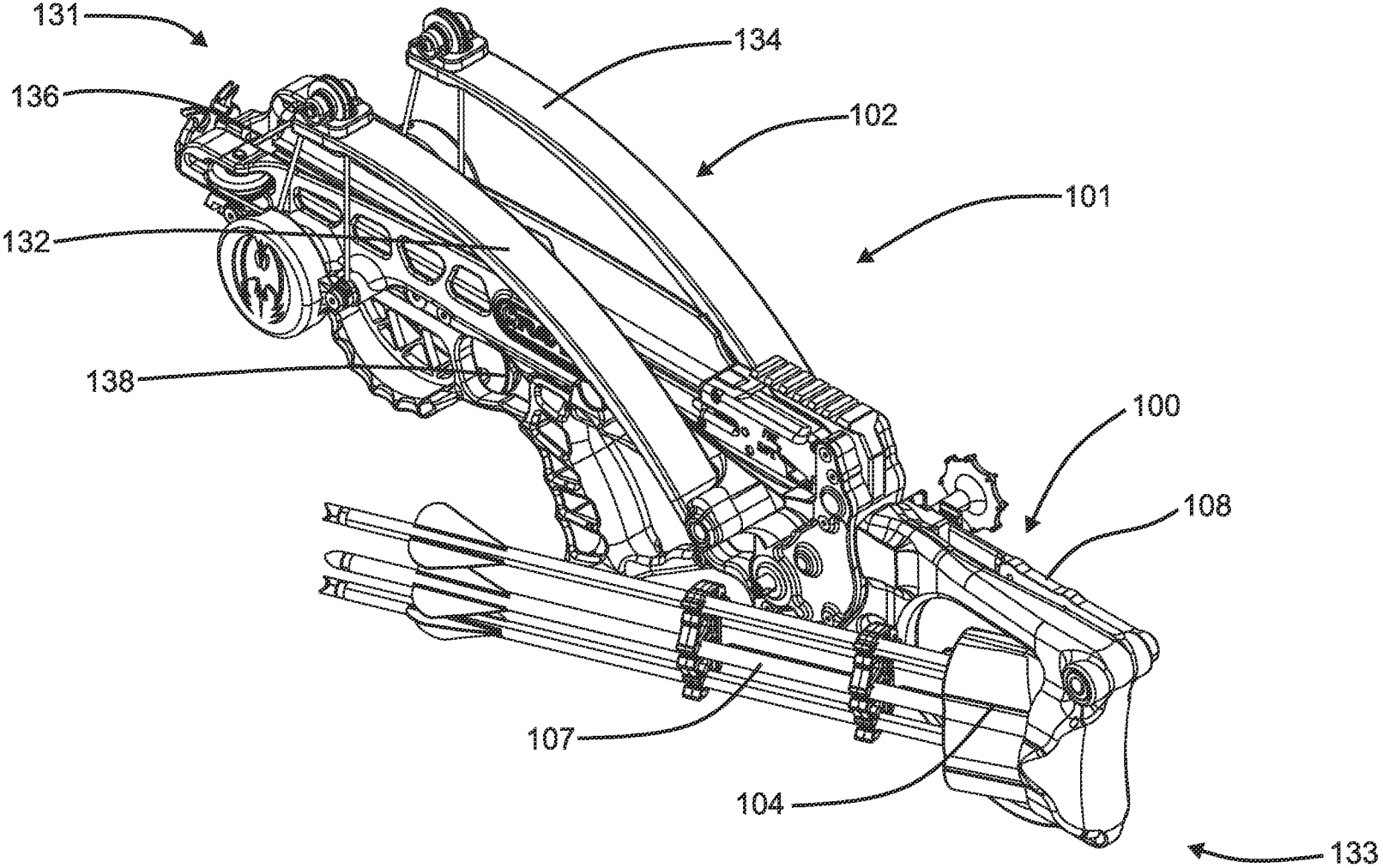
FIG. 1 shows a perspective view of a weapon system, according to one example of the present disclosure.
Figure 2:
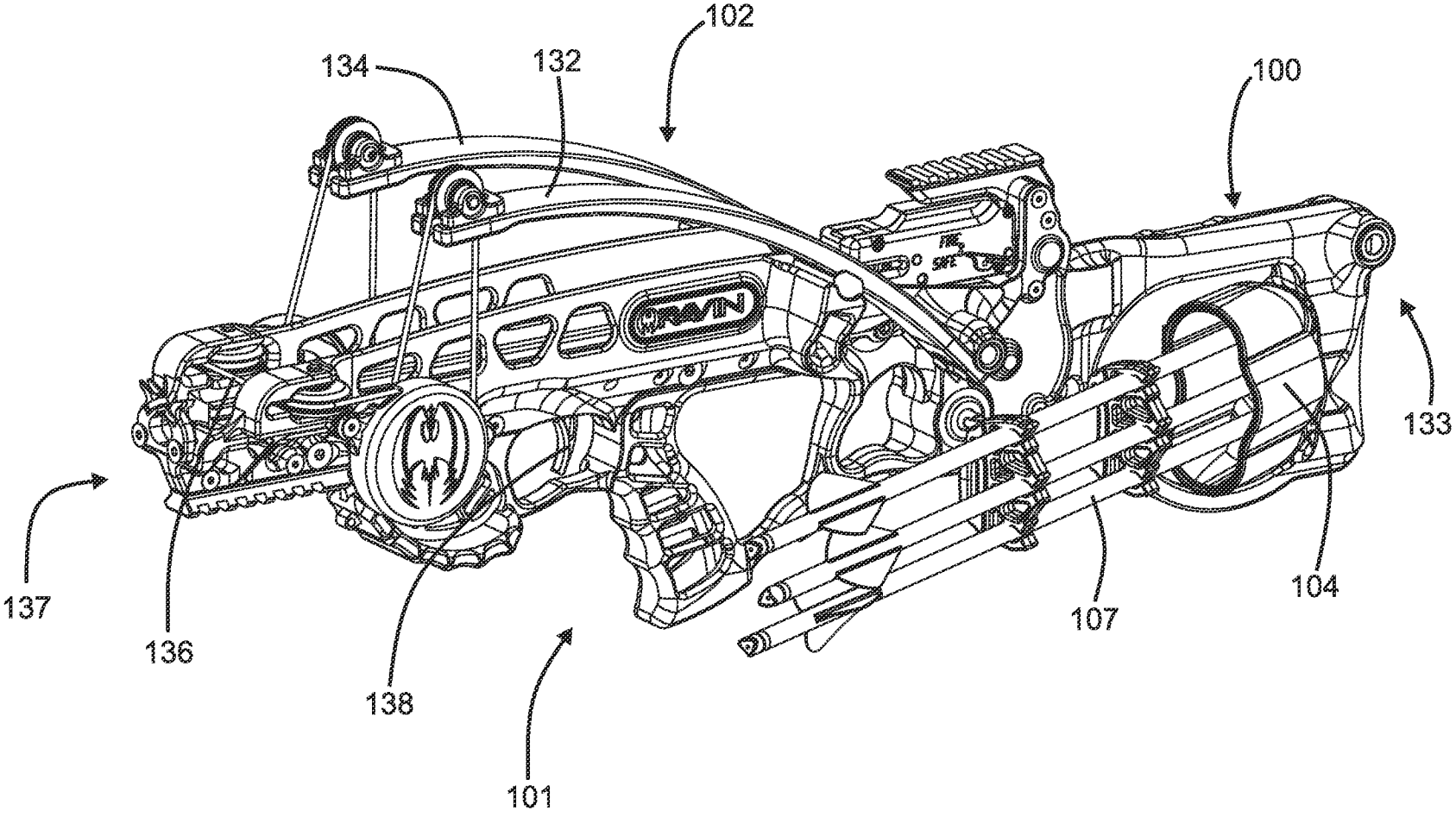
FIG. 2 shows another perspective view of the weapon system of FIG. 1.
Figure 3:
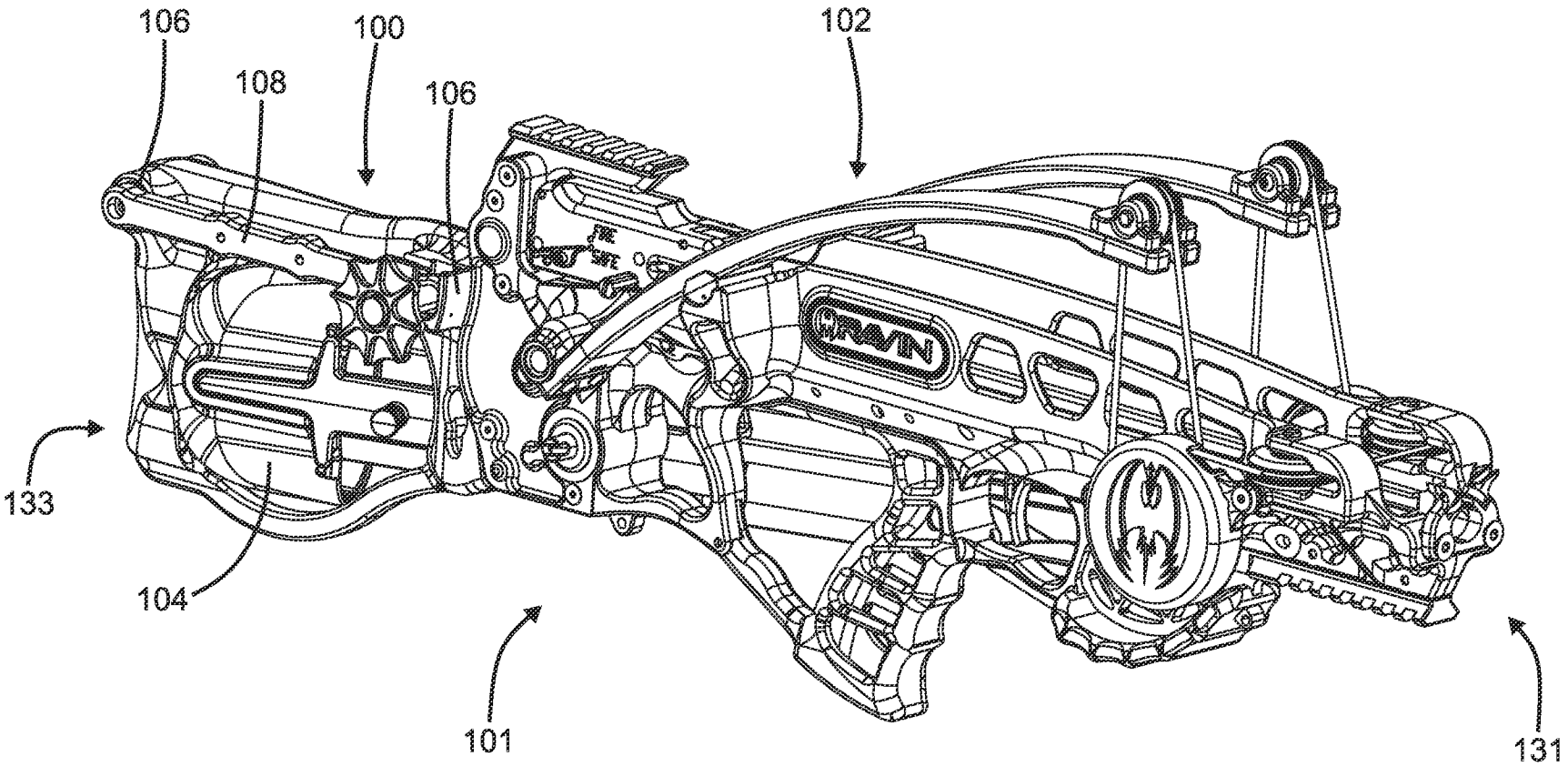
FIG. 3 shows another perspective view of the weapon system of FIG. 1.
Figure 4:
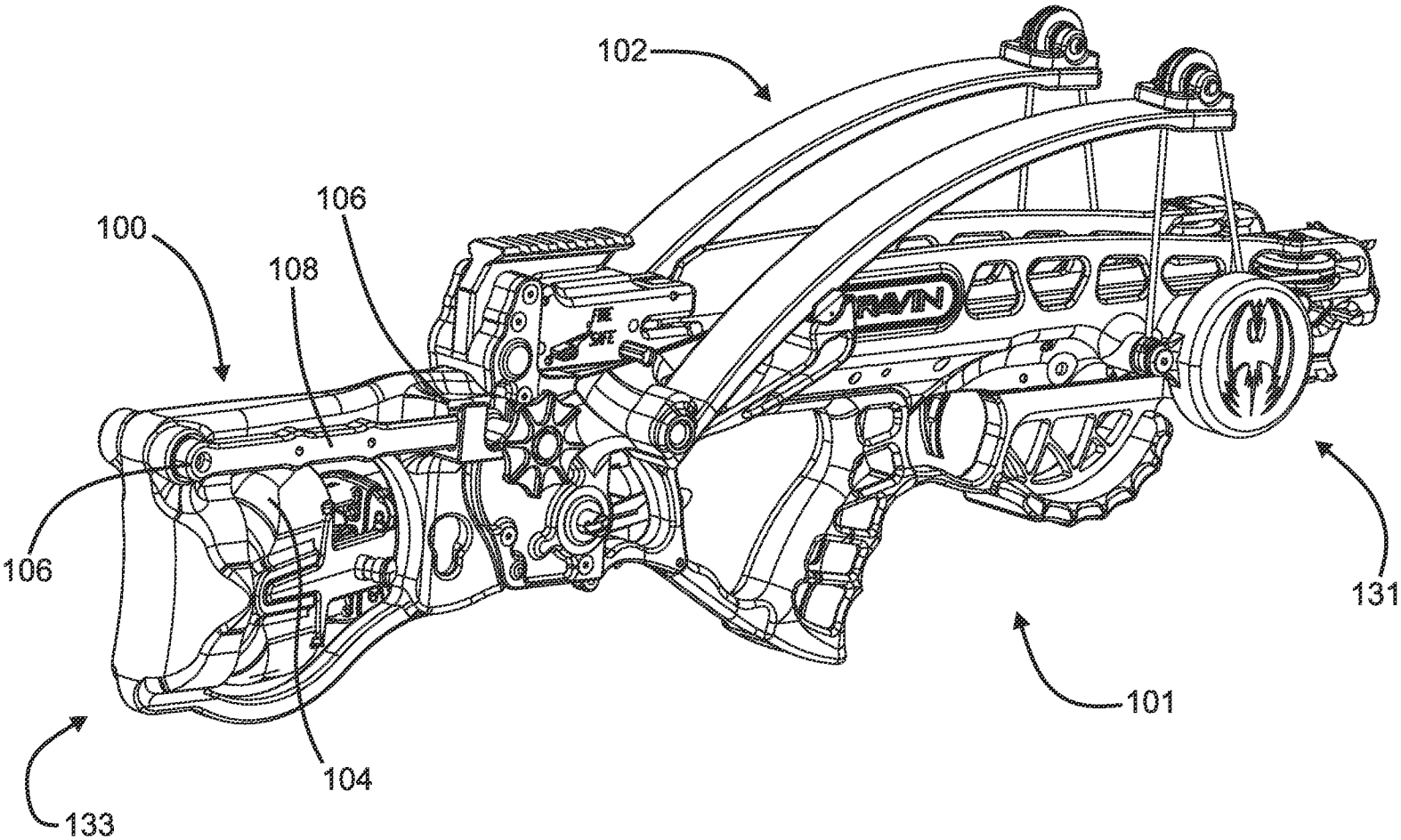
FIG. 4 shows another perspective view of the weapon system of FIG. 1.

Various embodiments will be described in detail with reference to the drawings, wherein like reference to numerals represent like parts and assemblies throughout the several views. Reference to various embodiments does not limit the scope of the claims attached hereto. Additionally, any examples set forth in this specification are not intended to be limiting and merely set forth some of the many possible embodiments for the appended claims.

A stock 100 for a weapon is disclosed herein. The stock 100 is configured to be positioned against a user's shoulder to stabilize the attached weapon. In some examples, the stock 100 is configured for use with a projectile launcher, such as a crossbow. In some examples, the stock 100 includes a mounting feature 109 for a quiver 104. In some examples, the stock includes a storage feature 106 for storing an arming tool 108 (e.g., a hand crank) for a crossbow. In some examples, the stock 100 can be mounted to an auxiliary location (e.g., a user's belt, backpack, etc.) to allow for full maneuverability of the weapon until the user needs to attach the stock to the weapon for firing. For example, a user can attach the stock 100 to the user's belt while hiking to a hunting location. Once at the hunting location, the user can attach the stock 100 to the weapon and improve the stability of the weapon during firing.

FIGS. 1-4 show perspective views of a weapon system 101 including a projectile launcher 102 with the stock 100. The stock 100 is shown including a quiver 104 removably attached thereto, and a storage feature 106 for an arming tool 108.

The projectile launcher 102 is configured to propel a projectile from a front end 131. The projectile launcher 102 operates by utilizing flexible limbs 132, 134 that are flexed by drawing a drawstring 136 toward a rear end 133. As the drawstring 136 is drawn rearward, the limbs 132, 134 that are connected thereto are drawn downward and loaded. Once fully rearward, the drawstring 136 can be released by a trigger 138 to propel a projectile 107 (i.e., an arrow) toward the front end 131. While a projectile launcher 102 is shown, it is considered within the present disclosure that a variety of different weapons can be utilized, such as a firearm.

Figure 5:
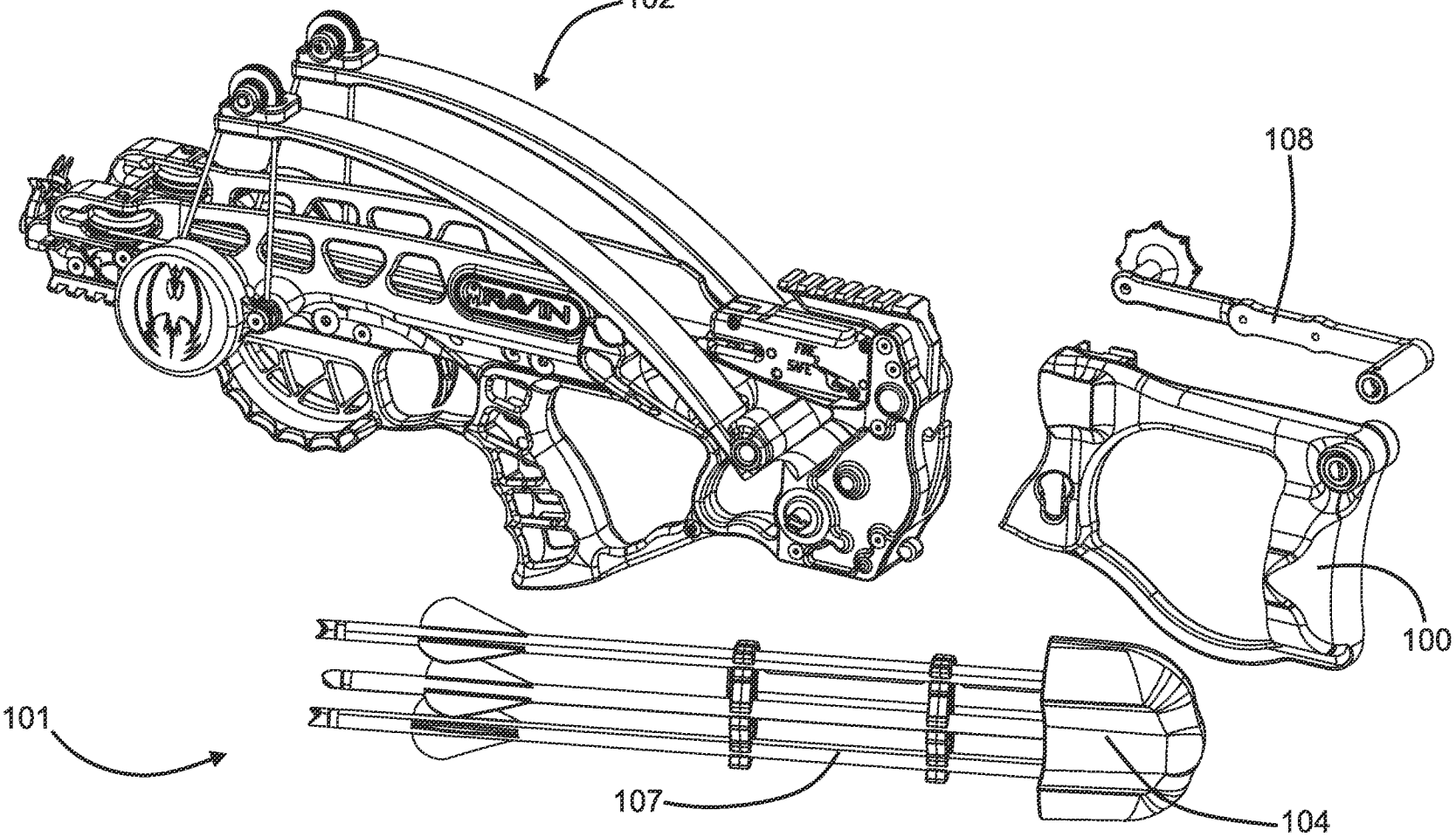
FIG. 5 shows an exploded view of the weapon system of FIG. 1.

FIG. 5 shows the stock 100, quiver 104, and arming tool 108 separated from the projectile launcher 102.

Figure 6:
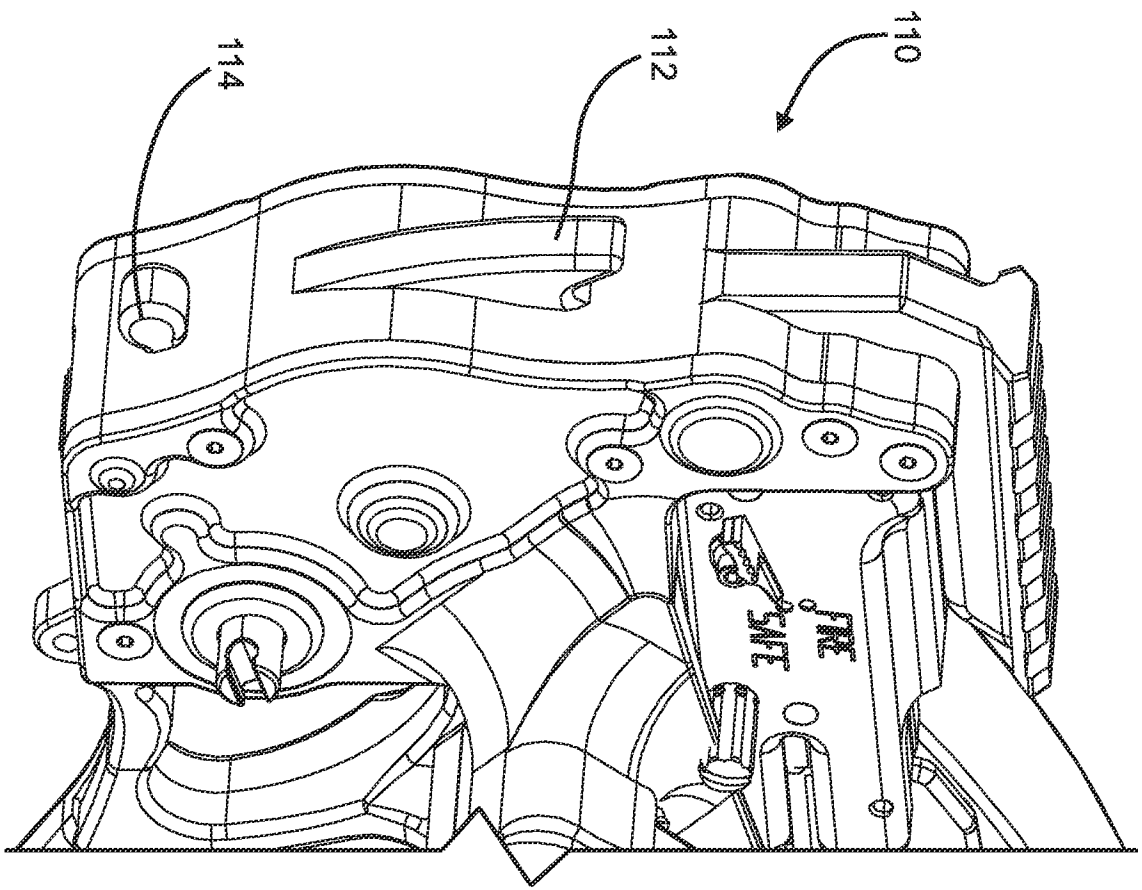
FIG. 6 shows a perspective view of a rear interface of a weapon, according to one example of the present disclosure.

As shown in FIG. 6, the projectile launcher 102 includes a rear interface 110 that is configured to mate with the stock 100. In some examples, the rear interface 110 includes at least two mating elements. In some examples, the mating elements include an upward facing hook 112 and a post 114.

Figure 7:
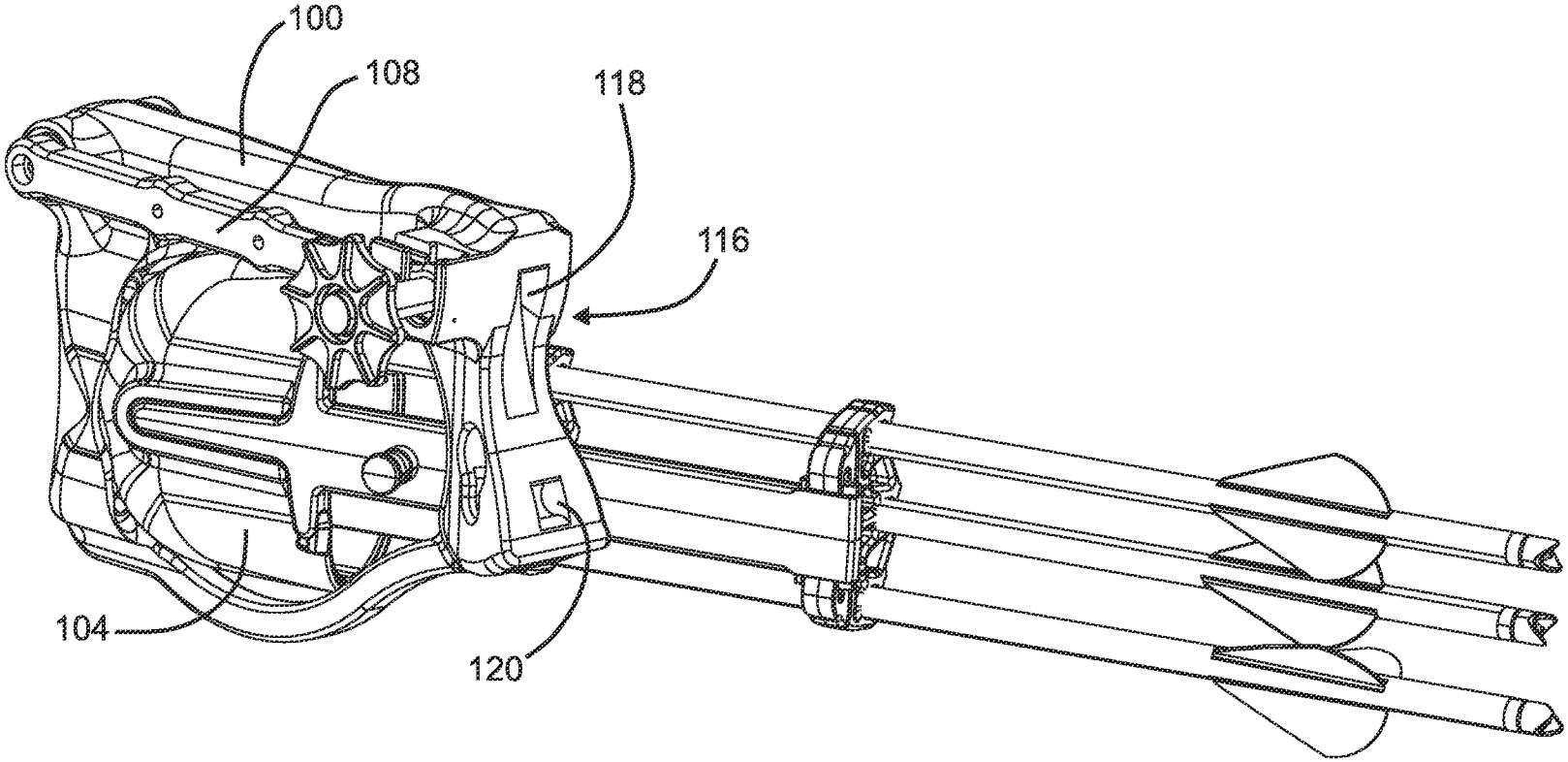
FIG. 7 shows a perspective view of a stock and a quiver, according to one example of the present disclosure.

As shown in FIG. 7, the stock 100 includes a stock interface 116 that is configured to mate with the rear interface 110 of the projectile launcher 102. In some examples, the stock interface 116 includes at least two mating elements. In some examples, the mating elements include a first mating element such as a hook recess 118 that is sized and shaped to mate with the hook 112 of the rear interface 110 and a second mating element such as a post recess 120 that is sized and shaped to mate with the post 114 of the rear interface 110. In some examples, the hook recess 118 has a vertical pocket 140.

In some examples, the first mating element is a pivotal connection element, which when connected to the rear interface of the weapon, permits the stock to pivot with respect to the weapon about the pivotal connection element.

In some examples the second mating element is an interference fit element that releasably engages the rear interface of the weapon with an interference fit. When the second mating element is engaged with the rear interface of the weapon, the stock is prevented from pivoting about the pivotal connection element. When the second mating element is disengaged from the rear interface of the weapon, the stock is free to pivot about the pivotal connection element.

In some examples the stock interface comprises one or more mating elements that provide a snap-fit connection with the rear interface of the weapon. In some examples the snap-fit connection is a toolless/tool free connection that can be connected and disconnected by hand without tools.

Figure 8:
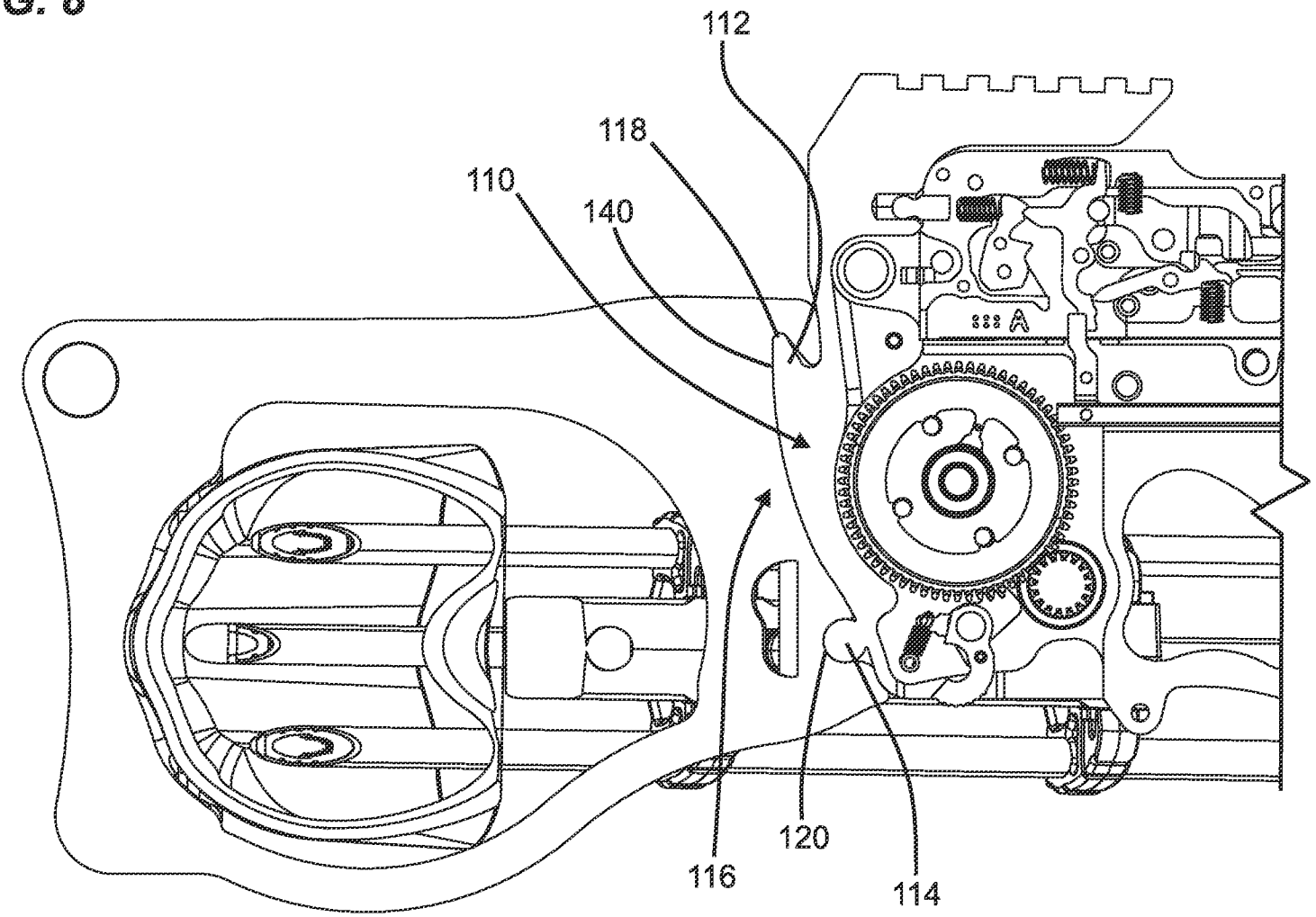
FIG. 8 shows a longitudinal cross section of the weapon system of FIG. 1.

As shown in FIG. 8, the hook 112 of the rear interface 110 is mated in the hook recess 118 of the stock 100 and the post 114 of the rear interface 110 is positioned within the post recess 120 of the stock 100. In some examples, the mating between the stock interface 116 and the rear interface 110 utilizes an interference fit. In some examples, an interference fit is used between the post 114 and the post recess 120. In some examples, the stock 100 can be removed from the projectile launcher 102 without the use of tools. It is considered within the scope of the present disclosure that a variety of different toolless connections can be used between the stock 100 and the projectile launcher 102. It is also considered within the present disclosure that the stock interface can include at least one projection that mates with at least one recess of the rear interface 110. For example, the post 114 and post recess 120 can be reversed in some embodiments such that the post 114 is part of the stock 100 body and the post recess 120 is part of the rear interface 110 of the weapon.

To attach the stock interface 116 to the rear interface 110, a user first mates the hook 112 and hook recess 118. This can be done by positioning the hook recess 118 above the hook 112 and guiding the hook into the recess 118. Once the user mates the hook 112 and hook recess 118, the user then pivots the stock 100 and exerts a force to position the post 114 within the post recess 120. This force is to ensure a mating between the stock interface 116 and the rear interface 110 via an interference fit. This interference fit will allow the stock 100 to stay attached to the projectile launcher 102 so that the connection between the stock 100 and the projectile launcher 102 is not loose. To remove the stock, a user exerts a force upward at a rear end 133 of the stock 100 of the projectile launcher 102 to break loose the interference fit between the post 114 and the post recess 120. Once released, the hook 112 can be slid out of the hook recess 118 and the stock 100 uncoupled with the projectile launcher 102.

FIG. 8 shows a longitudinal cross-section of the weapon system 101 of FIG. 1, including the stock interface 116.

Figure 9:
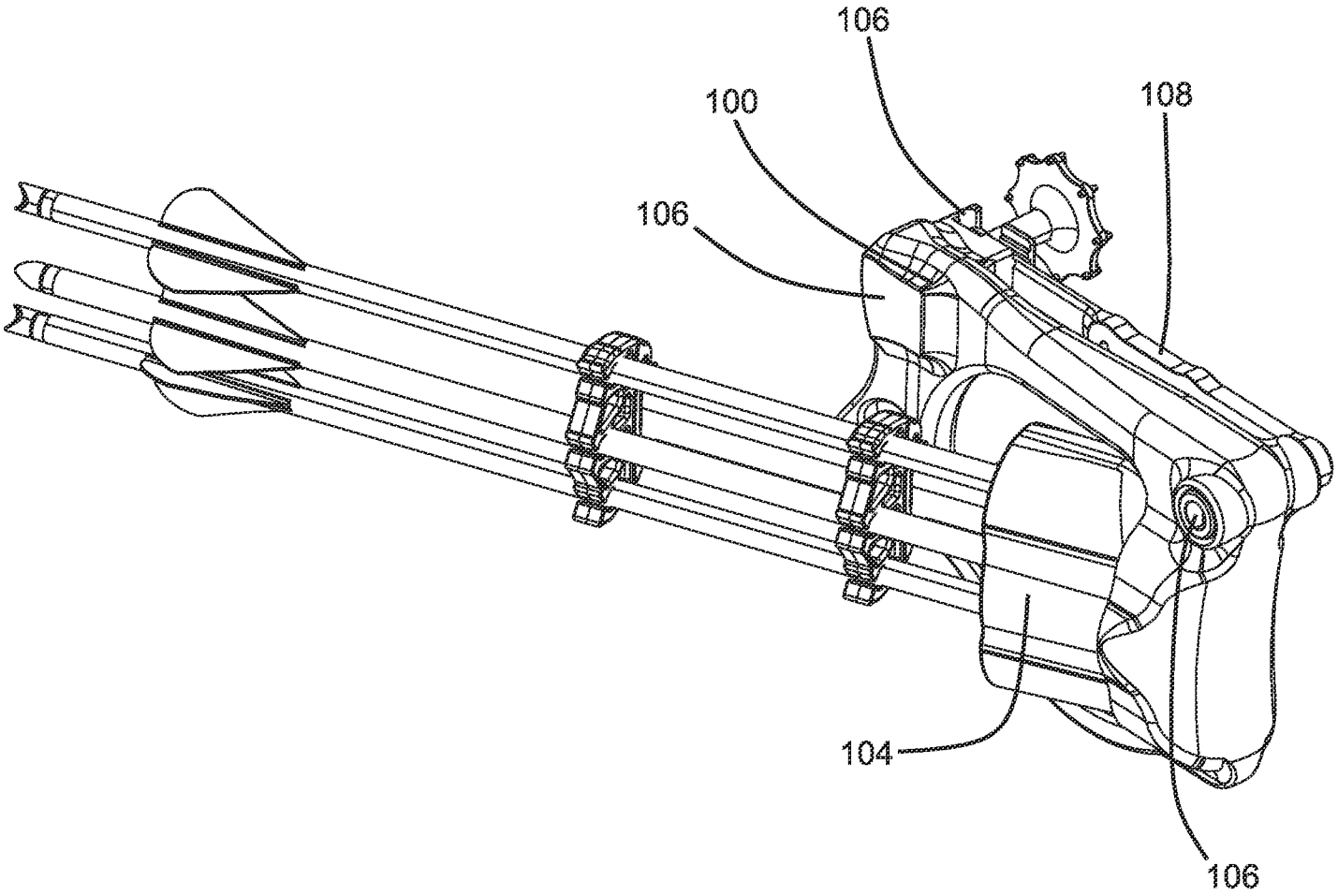
FIG. 9 shows another perspective view of the stock and the quiver of FIG. 7.
Figure 10:
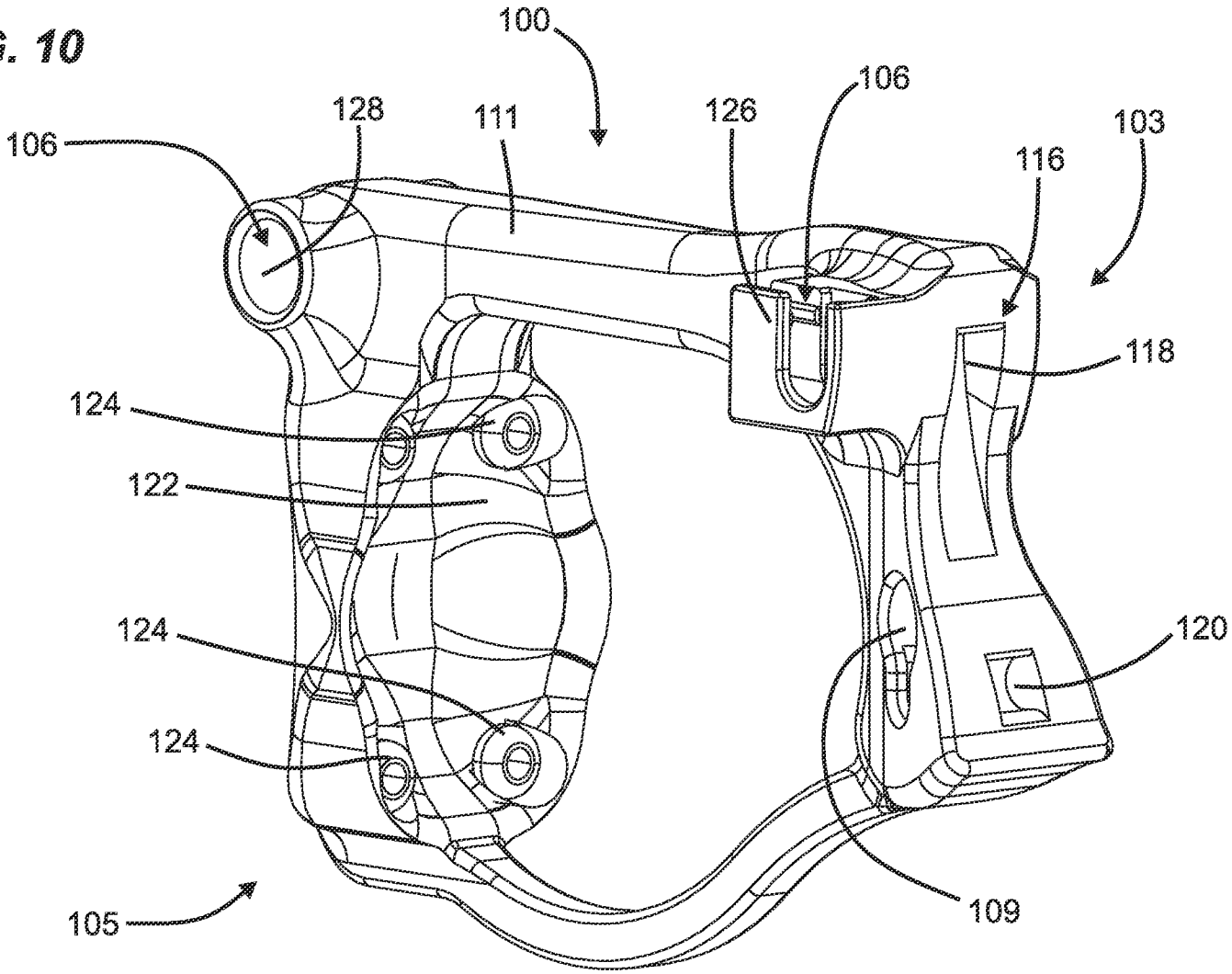
FIG. 10 shows a front perspective view of the stock of FIG. 7.
Figure 11:
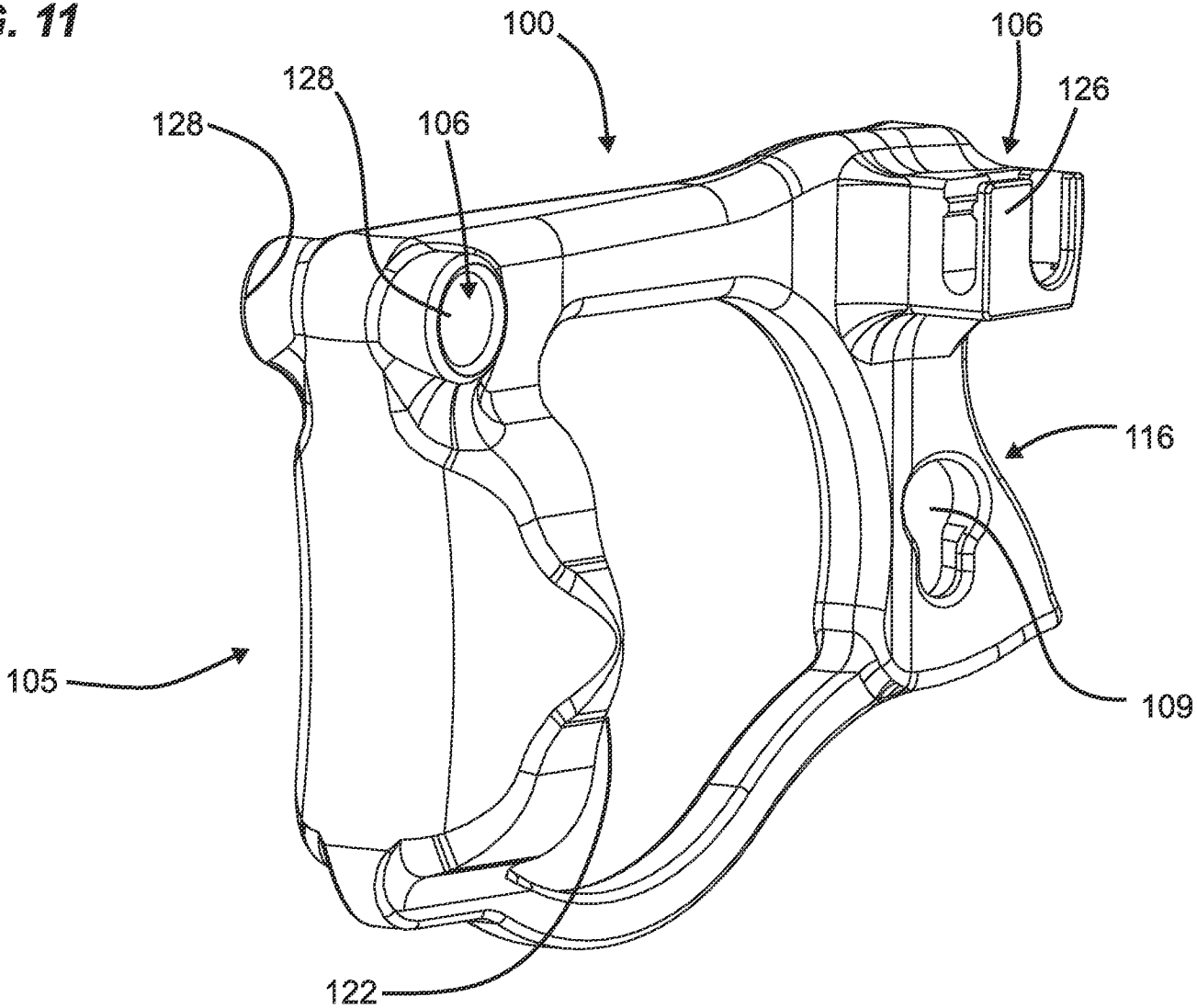
FIG. 11 shows a rear perspective view of the stock of FIG. 7.
Figure 12:
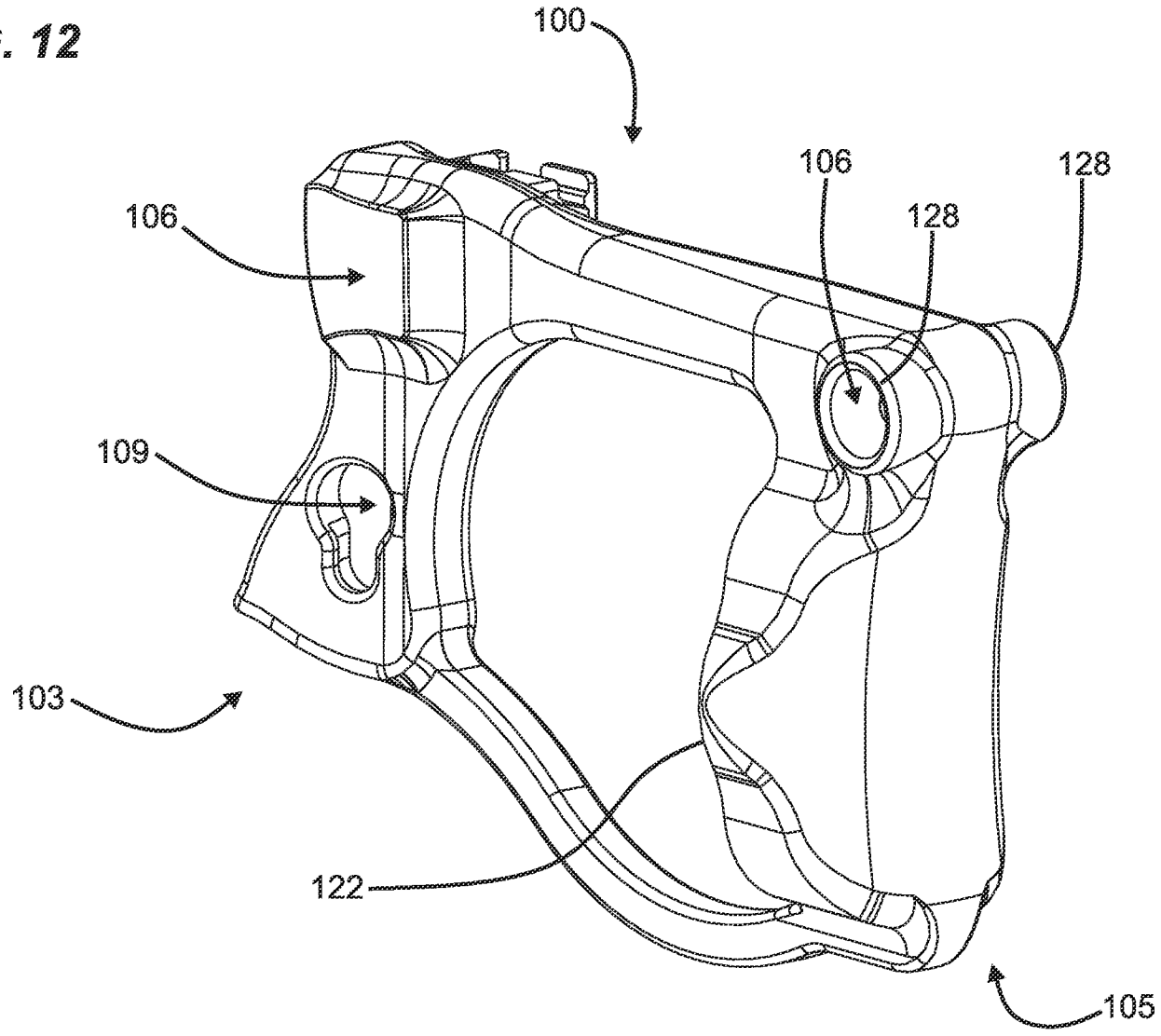
FIG. 12 shows another rear perspective view of the stock of FIG. 7.
Figure 13:
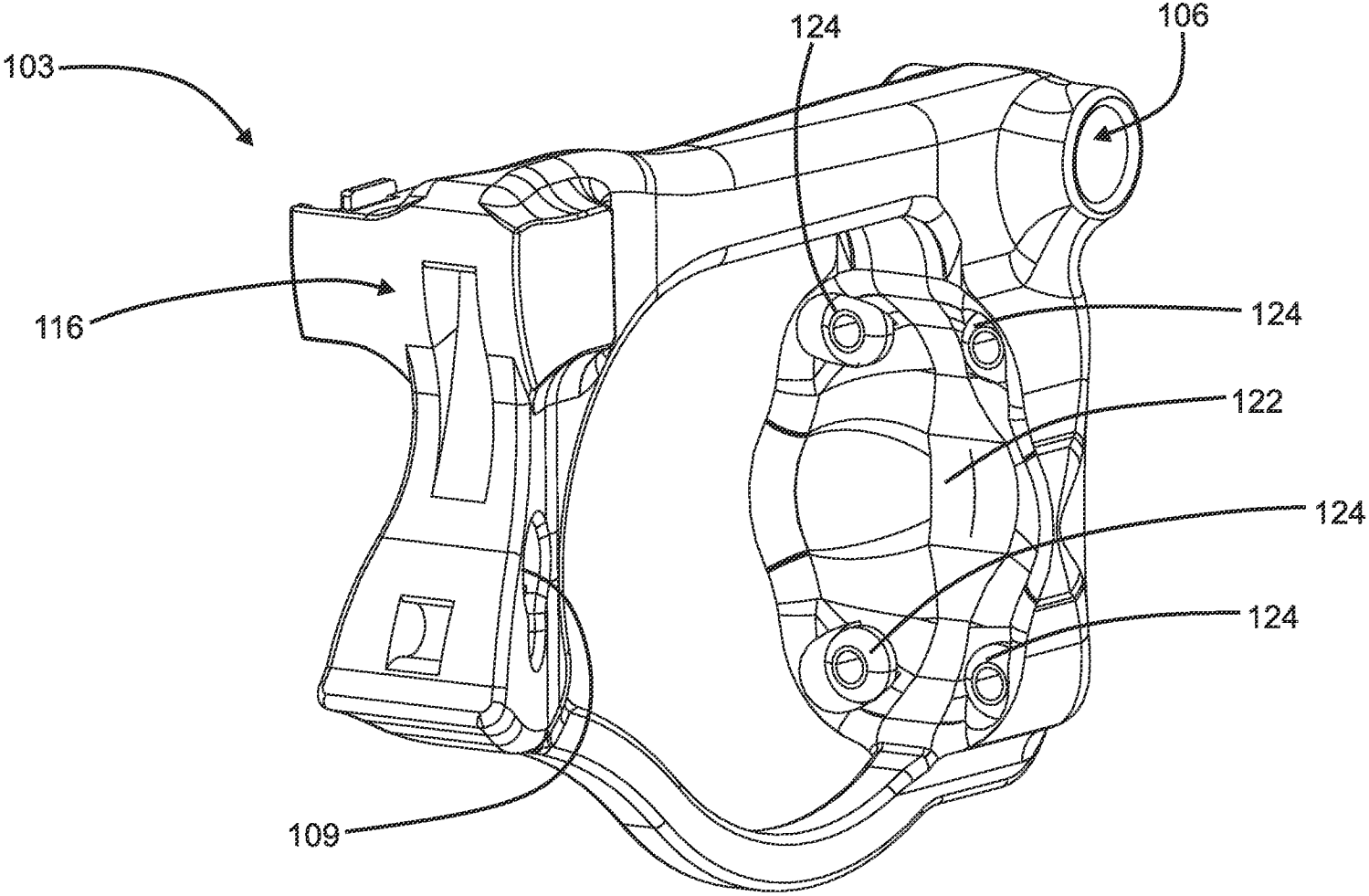
FIG. 13 shows another front perspective view of the stock of FIG. 7.

FIG. 9 shows a perspective view of the stock 100 with the attached quiver 104 and arming tool 108.

FIGS. 10-13 show the stock 100. The stock 100 includes a body 111 including a front end 103 and a rear end 105. At the front end 103, the stock 100 includes the stock interface 116, a plurality of quiver mounting features 109, and the arming tool storage feature 106. At the rear end 105, the stock 100 includes a quiver pocket 122, a plurality of quiver grips 124, and the arming tool storage feature 106.

In the depicted examples, the quiver 104 can be secured to either side of the stock 100 via the quiver mounting features 109. In some examples, the quiver mounting features 109 are apertures that are configured to mate to and secure the quiver 104. By allowing for mounting of the quiver 104 at either side of the stock 100, the stock 100 can be used by either right-handed or left-handed users.

In the depicted example, the arming tool storage feature 106 includes a cradle 126 at the front end 103 of the stock 100 and an aperture 128 at the rear end 105 of the stock 100. In some examples, the cradle 126 is part of a block that is detachable from the stock 100 and can be mounted to either side of the stock 100 for ambidextrous use.

The quiver pocket 122 is configured to receive an end of the quiver 104 to at least partially nest the quiver 104 within the stock 100. In some examples, the quiver grips 124 are positioned within the quiver pocket 122 so as to at least partially grip the quiver 104. In some examples, the quiver grips are rubber.

Figure 14:
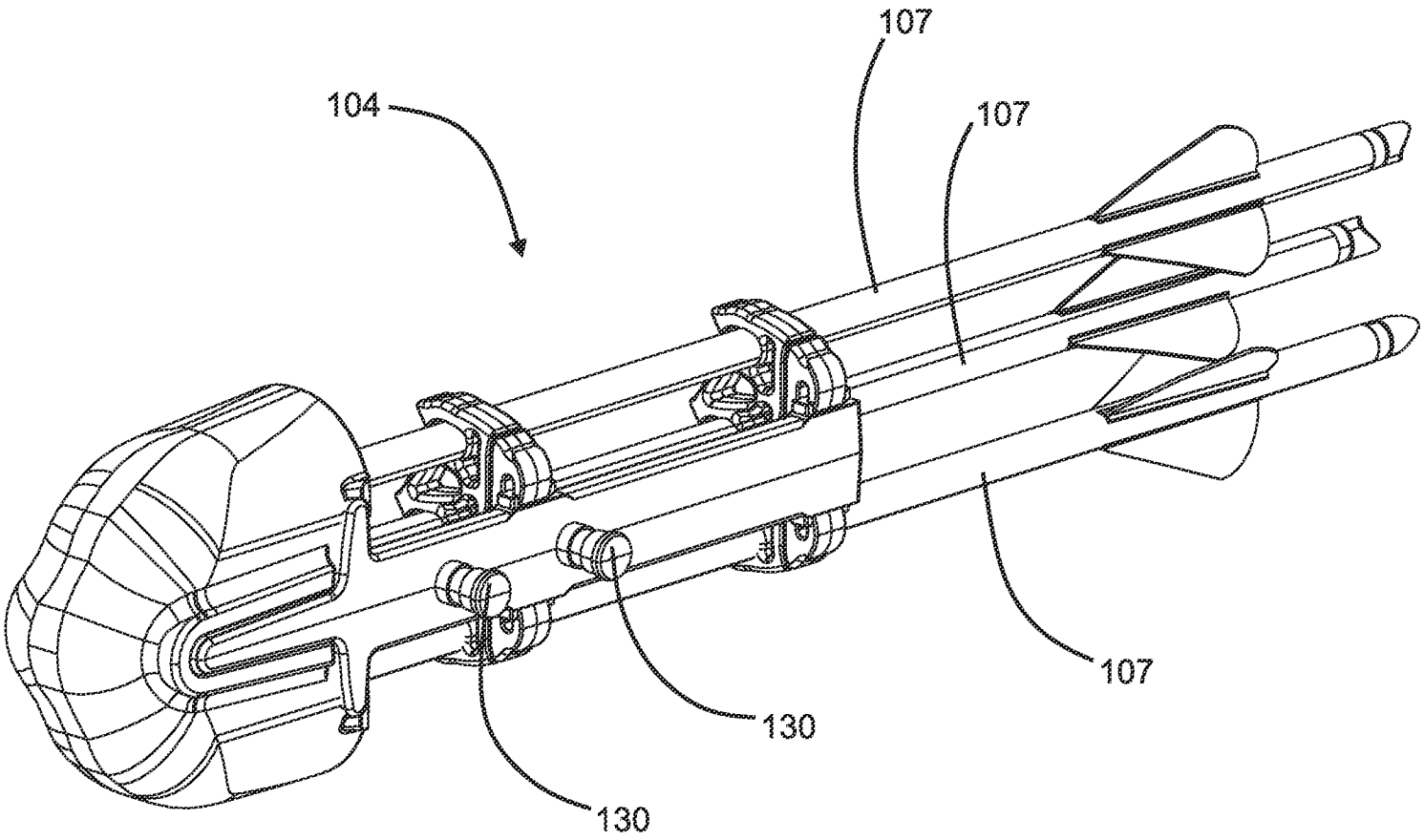
FIG. 14 shows a perspective view of the quiver of FIG. 7.

FIG. 14 shows a perspective view of the quiver 104. The quiver is configured to store the plurality of projectiles 107 (e.g., arrows). In some examples, the quiver 104 can include at least one stock mounting feature 130. In some examples, the quiver 104 includes a plurality of stock mounting features 130. In some examples, the stock mounting features 130 are posts. In some examples, the stock mounting features 130 are configured to mate to and secure the quiver mounting features 109 of the stock.

The various embodiments described above are provided by way of illustration only and should not be construed to limit the claims attached hereto. Those skilled in the art will readily recognize various modifications and changes that may be made without following the example embodiments and applications illustrated and described herein, and without departing from the true spirit and scope of the following claims.

In some examples, the components of the rear interface 110 of the weapon and the stock interface 116 of the stock 100 described with reference to FIGS. 5-9 are configured to be interchangeably positioned on either one of the rear interface 110 of the weapon and the stock interface 116 of the stock 100. For example, one or more of the hook recess 118 or the post recess 120 may be placed on the rear interface 110 of the weapon, while one or more of the hook 112 or post 114 is positioned on the stock interface 116 of the stock.

What is claimed is:

1. A removable stock for a crossbow, the stock comprising:

a body having a stock interface configured to removably couple the stock to a rear interface of the crossbow, the stock interface including at least a first and a second mating element, wherein the first mating element is a pivotal connection element which, when connected with the rear interface of the crossbow, permits the stock to pivot with respect to the crossbow about the pivotal connection element, and wherein the second mating element is an interference fit element that releasably engages the rear interface of the crossbow with an interference fit such that, when the second mating element is engaged with the rear interface of the crossbow, the stock is prevented from pivoting about the pivotal connection element, and when the second mating element is disengaged from the rear interface of the crossbow, the stock is free to pivot about the pivotal connection element.

2. The removable stock of claim 1, wherein the first mating element is a hook recess.

3. The removable stock of claim 1, wherein the second mating element is a post recess.

4. The removable stock of claim 1, wherein the second mating element comprises a protrusion.

5. The removable stock of claim 1, wherein the stock interface is configured to mate onto the crossbow without the use of tools.

6. The removable stock of claim 1, wherein the stock further comprises at least one quiver mounting feature on a first and second side of the body of the stock, thereby allowing a quiver to be mounted on either the first or the second side.

7. The removable stock of claim 6, wherein the stock further comprises a quiver pocket configured to at least partially receive a portion of a quiver therein, the quiver pocket having at least one quiver grip positioned therein.

8. The removable stock of claim 1, wherein the stock further includes an arming tool mount.

9. The removable stock of claim 8, wherein the arming tool mount has a cradle configured to receive an arming tool therein.

10. The removable stock of claim 8, wherein the stock defines an aperture configured to receive a portion of the arming tool therein.

11. A removable stock for a crossbow, the stock comprising:

a body having a stock interface configured to removably couple the stock to a rear interface of the crossbow, the stock interface including at least a first and a second mating element, wherein the first mating element is connectable to the rear interface of the crossbow, and wherein the second mating element is an interference fit element that releasably engages the rear interface of the crossbow with an interference fit such that, when the second mating element is engaged with the rear interface of the crossbow, the stock is prevented from moving at the first mating element, and when the second mating element is disengaged from the rear interface of the crossbow, the stock can move at the first mating element.

12. The removable stock of claim 11, wherein the first mating element is a hook recess.

13. The removable stock of claim 11, wherein the second mating element is a post recess.

14. The removable stock of claim 11, wherein the first mating element is a pivotal connection element.

15. The removable stock of claim 11, wherein the first mating element comprises a hook.

16. The removable stock of claim 11, wherein the second mating element comprises a post.

17. The removable stock of claim 11, wherein the first mating element is positioned above the second mating element when the stock is coupled to the crossbow.

18. The removable stock of claim 11, wherein the stock further comprises at least one quiver mounting feature on a first and second side of the body of the stock.

19. The removable stock of claim 18, wherein the stock further comprises a quiver pocket configured to at least partially receive a portion of a quiver therein, the quiver pocket having at least one quiver grip positioned therein.

20. The removable stock of claim 18, wherein the stock is configured to allow a quiver to be mounted on either the first or the second side.

* * * * *